United States Patent [19]

Lovatt

[11] 3,992,139

[45] Nov. 16, 1976

[54] SUPPORT ASSEMBLY FOR SUPPORTING POTTERY ARTICLES

[75] Inventor: William John Lovatt, Stoke-on-Trent, England

[73] Assignee: Acme Marls Limited, Stoke-on-Trent, England

[22] Filed: Mar. 24, 1975

[21] Appl. No.: 561,374

[30] Foreign Application Priority Data

Apr. 2, 1974 United Kingdom ..... 14556/74

[52] U.S. Cl. ..... 432/258; 34/239; 432/261

[51] Int. Cl.[2] ..... F27D 5/00

[58] Field of Search ..... 432/258, 261; 34/239

[56] References Cited

UNITED STATES PATENTS

| | | | |
|---|---|---|---|
| 1,895,408 | 1/1933 | Davis | 432/258 |
| 1,903,119 | 3/1933 | Ladd | 432/258 |
| 1,969,126 | 8/1934 | Forse | 432/258 |
| 2,879,577 | 3/1959 | Milburn | 432/258 |

FOREIGN PATENTS OR APPLICATIONS

| | | | |
|---|---|---|---|
| 1,444,625 | 5/1966 | France | 432/258 |

*Primary Examiner*—John J. Camby
*Attorney, Agent, or Firm*—Friedman, Goodman & Teitelbaum

[57] ABSTRACT

A support assembly unit and a support assembly formed from such units which can be mounted on a kiln car to support pottery being fired. The unit comprises upper and lower shelves having through holes which receive upper and lower spigots of a plurality of uprights. Each upright is a unitary structure with one or more spigots at the upper and lower ends and may have an intermediate shelf support upon which an intermediate shelf can be rested.

4 Claims, 9 Drawing Figures

SUPPORT ASSEMBLY FOR SUPPORTING POTTERY ARTICLES

BACKGROUND OF THE INVENTION

1. Field of the Invention

This invention relates to a support assembly for pottery articles during treatment in a kiln. The support assembly may be mounted on a kiln car and conveyed through a tunnel kiln for example.

2. Description of the Prior Art

Conventional such assemblies comprise a plurality of uprights which support shelves, the components being cemented together at every joint.

In a tunnel kiln, the kiln cars run on tracks similar to railway tracks and may bump against each other during their passage through the kiln, causing mechanical shock to be transmitted to the support assembly. Furthermore, because of the high temperatures used in kiln processes, strong thermal stresses may also occur due to expansion.

Where a support assembly for pottery articles is cemented together, there is no "play" between the components and any mechanical or thermal stress can and frequently does cause damage to the structure, which may weaken it or cause partial or total collapse with consequent damage to the pottery being treated in the kiln and possible obstruction of the kiln.

Such cemented structures also lack the ability to be readily dismantled and reassembled or altered its shape.

Other arrangements have been proposed in which the components, that is the uprights and shelves, have not been cemented together, in an attempt to avoid the above-mentioned disadvantages. If the uprights are simply used as props for the shelves, the uprights can move or tilt under mechanical or thermal stress and may leave the edges or corners of upper shelves unsupported, for example, leading to damage or possible collapse of the support assembly. To allow for this, it has proved necessary to make the props larger than would otherwise be required and this increases the ratio of the weight of the support assembly to the weight of the pottery supported thereby. This ratio, known as the "dead weight ratio", must be kept as low as possible in order to avoid the wastage of excessive amounts of heat in heating up the support assembly rather than the pottery being treated.

To reduce the instability of such arrangements, it has been proposed to use shelves having shallow blind recesses, the uprights having shallow bosses which are engageable within the recesses. In order to satisfactorily manufacture the shelves, the recesses must be relatively shallow and outwardly tapering and it is therefore impossible to interlock the components firmly. It is also necessary to make the shelves thicker than would otherwise be the case in order to provide sufficient thickness for the recesses to be incorporated and this again results in the dead weight ratio being increased.

SUMMARY OF THE INVENTION

It is an object of the invention to provide a support assembly unit and a support assembly formed from such units, for supporting pottery articles during kiln treatment, which overcomes or reduces some or all of these disadvantages.

According to the invention there is provided a support assembly unit comprising a plurality of uprights, each upright comprising a unitary structure having spigots extending from the upper and lower ends thereof, and a pair of shelves assembled to the upper and lower ends respectively of the uprights by means of said spigots, the shelves having a plurality of through holes corresponding in number to the number of spigots, the spigots being received in respective through holes.

The term "unitary structure" is intended to mean that the upright is handled as a single unit and is not intended to imply that it is made as a single piece. Where a plurality of pieces are used, these are rigidly secured together.

In one form, an upright may comprise a tube having a pin extending through and permanently secured within the bore thereof and projecting from the upper and lower ends thereof to provide said spigots.

Alternatively, an upright may comprise a pair of tubes, each having a respective pin extending through and permanently secured within the bore of the tube and projecting from the upper and lower ends thereof to provide a pair of spigots at the upper end and a pair of spigots at the lower end of the upright, the two tubes being permanently interconnected to form an upright. The interconnection may be achieved by means of straps having through holes through which the spigots protrude, the straps being rigidly secured to the upright.

According to a further aspect of the invention there is provided a support assembly for supporting pottery articles during treatment in a kiln, the assembly comprising a plurality of support assembly units interengaged with each other, each unit being as set out above in accordance with the first aspect of the invention.

BRIEF DESCRIPTION OF THE DRAWINGS

The invention will now be described in more detail by way of example only with reference to the accompanying informal drawings in which.

DETAILED DESCRIPTION OF THE PREFERRED EMBODIMENT

Figure 1:
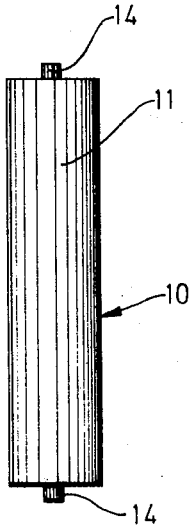
FIG. 1 shows one embodiment of the upright.
Figure 2:
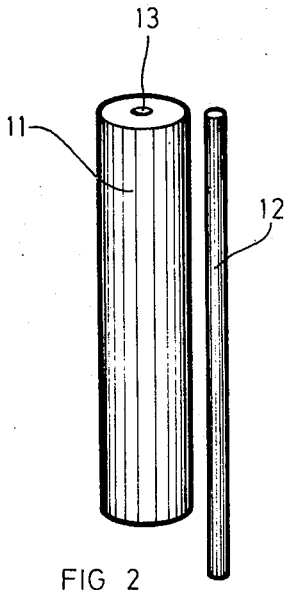
FIG. 2 shows the components used to form the upright of FIG. 1.

Referring firstly to FIGS. 1 to 4, these show in assembled and disassembled condition, the components of a single and a double upright forming part of a supporting assembly embodying the invention. The single support indicated at 10 is shown in FIG. 1 and comprises a tube 11 and a central pin 12 which is cemented within a hole 13 of the tube 11. The extreme end portions of the pin 12 project at 14 to form a pair of spigots.

Figure 3:
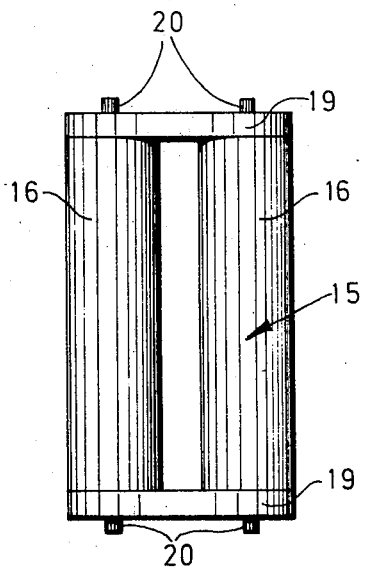
FIG. 3 shows a double upright.
Figure 4:
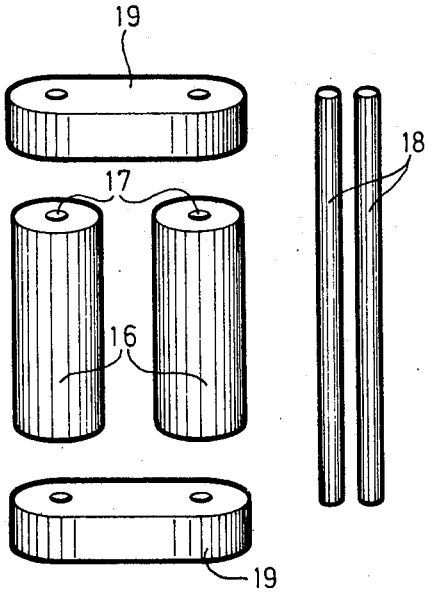
FIG. 4 shows the components used in the formation of the double upright shown in FIG. 3.

FIG. 3 shows a double upright generally indicated at 15 and this comprises a pair of tubes 16 having central holes 17, each of which receives a pin 18 which is cemented therein. End portions of the pins 18 extend from the ends of the tubes 16 and straps 19 are provided, each having a pair of holes, these straps engaging over the end portions of the pins 18 and being cemented in position. In the finished assembly, the extreme end portions 20 of the pins 18 extend beyond the straps to provide spigots 20.

Figure 5:
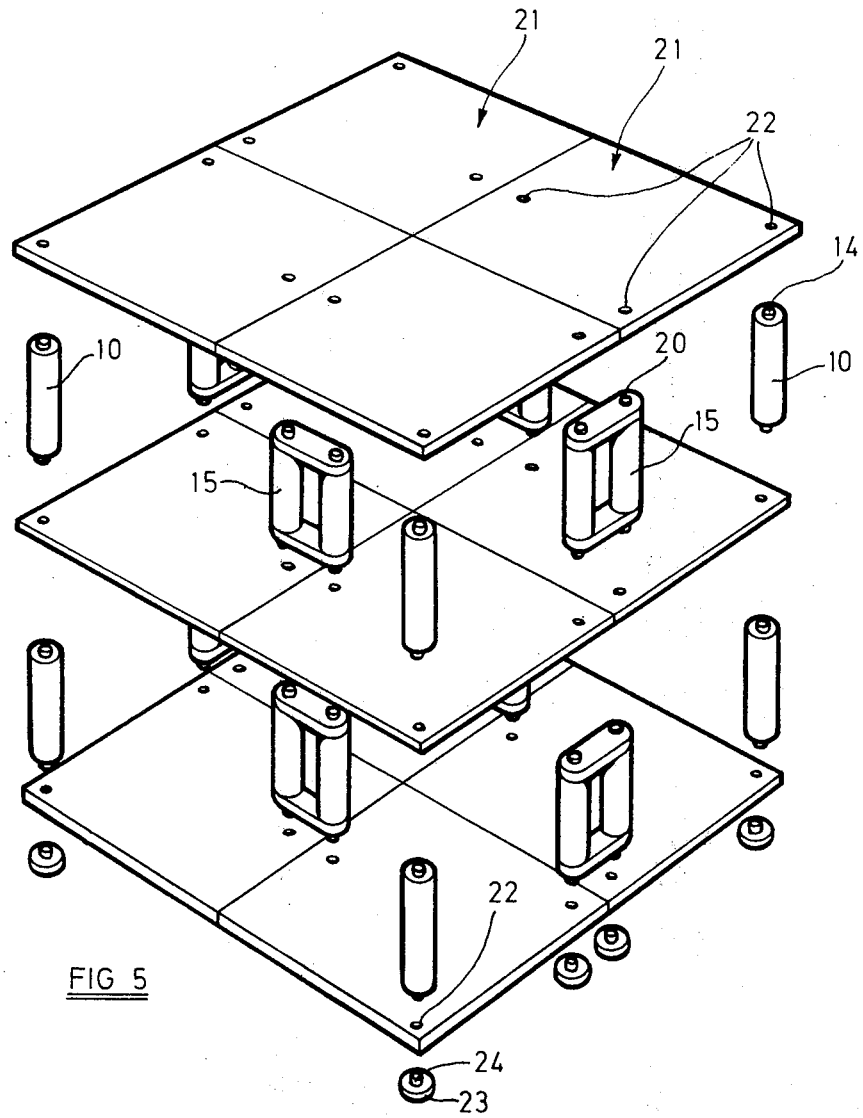
FIG. 5 is an exploded perspective view of a support assembly embodying the invention.

Turning now to FIG. 5 of the drawings, this illustrates a support assembly using the single and double supports 10 and 15. The support assembly comprises a plurality of shelves which are indicated at 21. Each shelf has three through holes 22 which are of a suitable size to receive the spigots 14, 20 of the uprights 10, 15. It will be seen that single uprights 10 are used at the corners of the assembly and that double uprights 15 are used to link together two shelves which are in co-planar side by side relationship.

Below the assembly proper, small discs 23 are provided as supports and these discs are mounted on a kiln car (not shown). The discs 23 have upstanding spigots 24 which engage within the holes 22 of the shelves.

It will be appreciated that each hole of the bottom layers of shelves receives spigots which extend upwardly from below and also downwardly from above and it is therefore evident that the thickness of the shelf is related to the length of the spigots in such a way that sufficient interconnection can be achieved between the spigots and the through holes 22.

Referring now to FIGS. 6 to 9, it may be desirable to have a basic structure similar to that shown in FIG. 5 of the drawings but having provision to enable intermediate shelves to be disposed between the main layers of shelves of the assembly. In this case, single and double uprights may be provided in the form shown in FIGS. 7 and 6 respectively.

Figure 7:
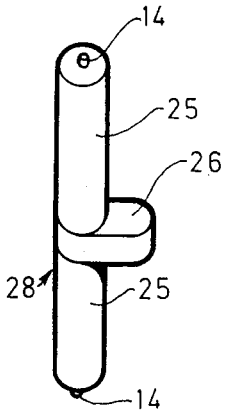

The single upright shown in FIG. 7 is very similar to the single upright shown in FIG. 1 but instead of using a single tube 11, a pair of tubes 25 are provided which are somewhat less than half the length of the tube 11 and between these tubes 25 a shelf rest 26 having a through hole, is disposed. The pin passes through the lower tube 25, the shelf support 26 and the upper tube 25 and is cemented in position so as to leave spigots 14 extending from the upper and lower ends.

The double upright is formed in a similar fashion but in this case the shelf support 27 has two holes and acts as a further strap between the two parts of the upright.

Figure 6:
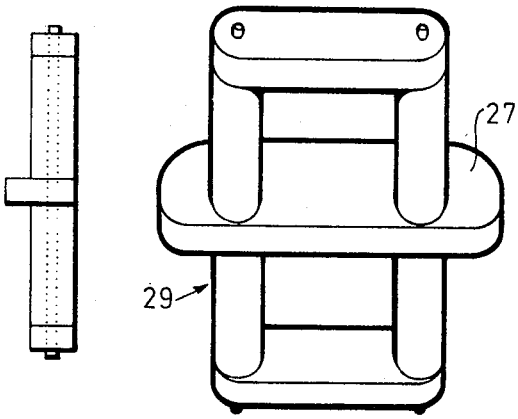
FIG. 6 and FIG. 7 show respectively double and single uprights provided with means for supporting intermediate shelves.
Figure 8:
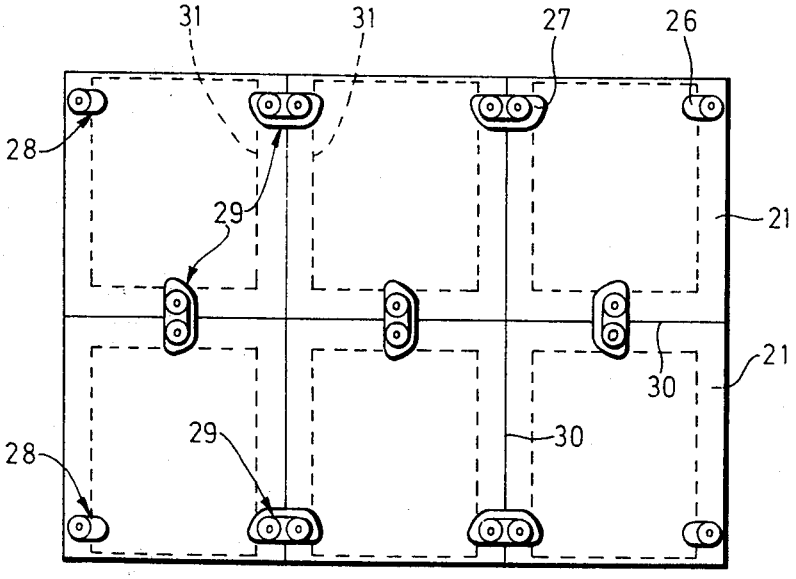
FIG. 8 is a plan view of an assembly including such intermediate shelves.
Figure 9:
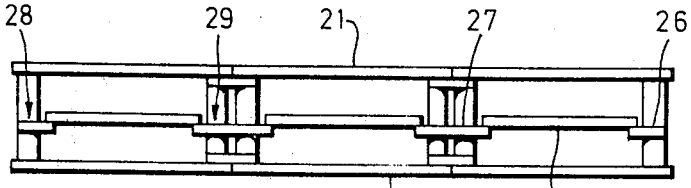
FIG. 9 is a front elevational view of the assembly shown in FIG. 8.

The assembly shown in FIGS. 8 and 9 is typical of assemblies having intermediate shelving which can be built up using the single and double uprights indicated at 28 and 29 in FIGS. 7 and 6.

The plan view shown in FIG. 8 indicates clearly that the main shelves 21 abut against each other along edges 30. The intermediate shelves are smaller and are indicated in dotted lines at 31. These intermediate shelves

31 rest on the shelf supports 26, 27 of the single and double upright supports 28, 29.

It will be seen from FIG. 9 that the upper and lower tubes of each upright may be unequal in length so that, when the intermediate shelves 31 are slid into the assembly so as to be supported by the shelf supports 26 and 27, the spacing between the shelves is equal. However, it will be apparent that the arrangement of the shelves is a matter of choice and that by choosing suitable dimensions for the components of the uprights 28 and 29, the spacing of the intermediate shelves 31 from the main shelves 21 may be selected.

The support assembly may be muffled by means of muffles which are fixed between the uprights, in order to avoid the need to muffle the kiln. The muffles may be hinged like doors and will be maintained in a closed position by means of clips which can be released when it is required to open the muffles.

I claim:

1. A support assembly for supporting pottery articles during treatment in a kiln, comprising a plurality of uprights, a plurality of shelves each having a plurality of through holes, at least two of said shelves being disposed edge to edge to constitute upper shelves, at least two of said shelves being disposed edge to edge to constitute lower shelves, said uprights each being a unitary structure including a tube and pin assembly comprising a tube of constant cross section and a pin of constant cross section permanently and rigidly secured within the tube and projecting at both ends there of to provide upper and lower spigots respectively, at least some of said uprights also comprising a further tube and pin assembly permanently and rigidly secured in parallel to the first mentioned tube and pin assembly whereby such uprights afford two upper spigots and two lower spigots, the upper spigots being engaged in through holes of a pair of adjacent upper shelves and the lower spigots being engaged in through holes of a pair of adjacent lower shelves.

2. A support assembly according to claim 1 wherein a pair of straps are provided and permanently and rigidly secured together the first and second tube and pin assemblies, one strap interconnecting the upper end of the assemblies and the other strap interconnecting the lower ends of the assemblies and each strap having a pair of through holes through which a pair of said spigots project.

3. A support assembly according to claim 1 wherein at least some of said uprights comprise an intermediate shelf support permanently and rigidly secured thereto at a position spaced from the upper and lower ends there.

4. A support assembly according to claim 1 wherein the tubes and the pins are formed as extrusions in ceramic material.

* * * * *